US006923342B2

(12) United States Patent
Bourque et al.

(10) Patent No.: US 6,923,342 B2
(45) Date of Patent: Aug. 2, 2005

(54) SYSTEMS FOR DISPENSING MULTI-COMPONENT PRODUCTS

(75) Inventors: Steven M. Bourque, Bradford, MA (US); James L. Salemme, Billerica, MA (US)

(73) Assignee: The Gillette Company, Boston, MA (US)

( * ) Notice: Subject to any disclaimer, the term of this patent is extended or adjusted under 35 U.S.C. 154(b) by 82 days.

(21) Appl. No.: 10/436,850

(22) Filed: May 12, 2003

(65) Prior Publication Data

US 2004/0226964 A1 Nov. 18, 2004

(51) Int. Cl.[7] ..... B65D 83/14

(52) U.S. Cl. ..... 222/136; 222/94; 222/145.4; 222/386.5; 222/389; 222/402.24

(58) Field of Search ..... 222/135–137, 222/94, 145.1, 145.3, 145.4, 402.1, 386.5, 402.24, 389

(56) References Cited

U.S. PATENT DOCUMENTS

| | | | | |
|---|---|---|---|---|
| 2,941,696 A | * | 6/1960 | Homm | 222/136 |
| 3,241,722 A | | 3/1966 | Nissan | 222/136 |
| 3,318,488 A | | 5/1967 | Barnes | 222/182 |
| 3,335,913 A | | 8/1967 | Bouet | 222/95 |
| 3,421,661 A | | 1/1969 | Price | 222/94 |
| 3,451,596 A | | 6/1969 | Marand | 222/193 |
| 3,454,198 A | | 7/1969 | Flynn | |
| 3,455,489 A | | 7/1969 | Meshberg | 222/94 |
| 3,685,695 A | | 8/1972 | Yuhas | 222/129 |
| 3,721,371 A | | 3/1973 | Doiveck | 222/386.5 |
| 3,731,854 A | | 5/1973 | Casey | 222/386.5 |
| 3,791,557 A | | 2/1974 | Venus, Jr. | 222/105 |
| 3,825,159 A | | 7/1974 | Laauwe | 222/402.24 |
| 3,838,796 A | | 10/1974 | Cohen | 222/105 |
| 3,873,003 A | | 3/1975 | Seiferth et al. | 222/95 |
| 3,876,115 A | | 4/1975 | Venus, Jr. et al. | 222/183 |
| 3,894,659 A | | 7/1975 | Focht | 222/94 |
| 3,940,026 A | | 2/1976 | Kain | 222/212 |
| 3,951,310 A | | 4/1976 | Steiman | 222/95 |
| 3,976,223 A | | 8/1976 | Jass et al. | 222/94 |
| 4,222,499 A | | 9/1980 | Lee et al. | 222/183 |
| 4,387,833 A | | 6/1983 | Venus, Jr. | 222/95 |
| 4,423,829 A | | 1/1984 | Katz | 222/95 |
| 4,492,313 A | | 1/1985 | Touzani | 215/1 C |
| 4,496,081 A | * | 1/1985 | Farrey | 222/135 |
| 4,651,503 A | | 3/1987 | Anderson, III et al. | 53/440 |
| 4,727,914 A | | 3/1988 | Anderson, III et al. | 141/105 |
| 4,733,702 A | | 3/1988 | Anderson, III et al. | 141/105 |
| 4,964,540 A | | 10/1990 | Katz | 222/95 |
| 5,370,250 A | | 12/1994 | Gilbert | 215/100 |
| 6,142,170 A | * | 11/2000 | Belfer et al. | 137/240 |
| 6,299,024 B1 | | 10/2001 | Corba | 222/145.5 |
| 6,736,288 B1 | * | 5/2004 | Green | 222/94 |

FOREIGN PATENT DOCUMENTS

| | | |
|---|---|---|
| DE | 1632037 | 11/1970 |
| DE | 76 31 034 | 10/1978 |
| DE | 38 32 938 | 3/1990 |
| DE | 42 13 350 A1 | 10/1993 |
| EP | 0 549 096 A1 | 6/1993 |
| EP | 0757959 | 2/1997 |
| WO | WO 88/07963 | 10/1988 |
| WO | WO 02/34636 A1 | 5/2002 |
| WO | WO 02/34636 | 5/2002 |

OTHER PUBLICATIONS

M. Joseph–Eugene–Baptiste "DE Voyage ET DE Campement, ECT" Dec. 16, 1921.

* cited by examiner

*Primary Examiner*—J. Casimer Jacyna
(74) *Attorney, Agent, or Firm*—Fish & Richardson P.C.

(57) ABSTRACT

Systems for dispensing multi-component products are provided. In some implementations, the systems include a valve assembly having a multi-lobal valve stem.

19 Claims, 7 Drawing Sheets

FIG. 7
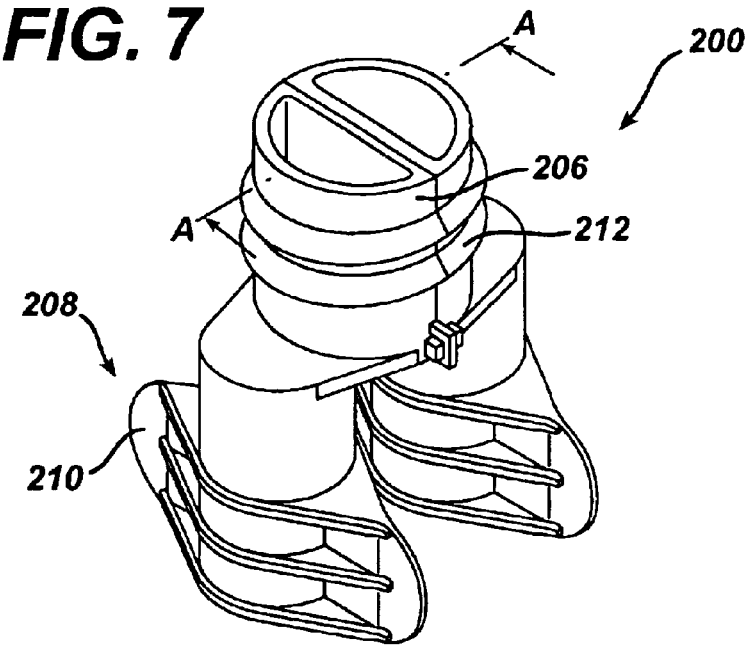
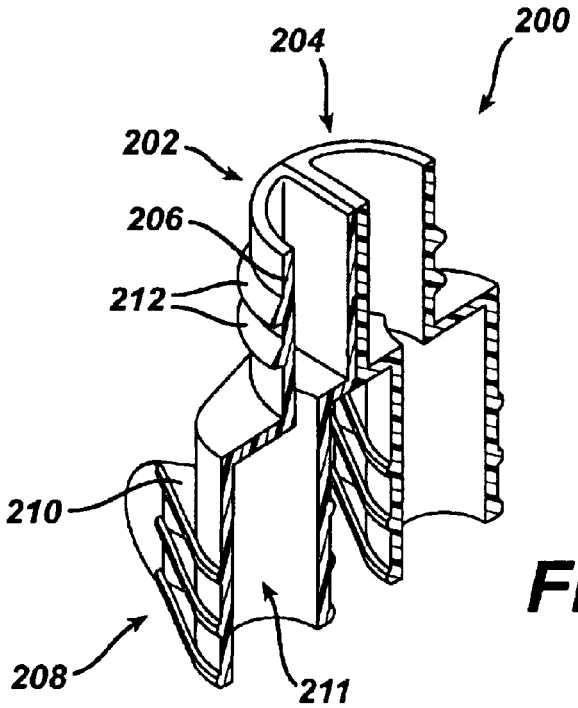
FIG. 7A

SYSTEMS FOR DISPENSING MULTI-COMPONENT PRODUCTS

TECHNICAL FIELD

This invention relates to systems for dispensing multi-component products.

BACKGROUND

It is often necessary, or desirable, to maintain one component of a multi-component product, e.g., a shaving cream, separate from other components of the product or from some part of the container in which the product is stored.

For example, the components of the product may react with each other when mixed, and it may be desired to prevent this reaction from occurring until the product is dispensed.

Moreover, in some cases it is important to keep one component of a multi-component product from contacting the container holding the product due to the reactive nature of the particular component, e.g., if the component reacts with metals and the container is metal or includes metal parts such as springs.

Other reasons for maintaining one component separate from other components include aesthetic reasons, e.g., to provide a "stripe" of one color against a background of another color when the product is dispensed.

Various systems have been used in the past to package and dispense products containing two components so that the components are separated during storage and mixed during or just prior to dispensing, e.g., as disclosed in U.S. Pat. Nos. 3,241,722 and 3,454,198.

SUMMARY

The present invention provides systems for dispensing multi-component products. Preferred systems maintain one component of the product completely separate from other components until the product is dispensed. Because the components do not contact each other until the instant that the product is dispensed, products including highly reactive components can be effectively dispensed. The systems are easily filled using mass production techniques, and preferred systems include a dispensing valve assembly that has a convenient modular design, allowing it to be easily assembled into the dispensing system.

In one aspect, the invention features a pressurized dispensing system for dispensing a multi-component product, including (a) a first chamber constructed to contain a first component of the product; (b) a second chamber constructed to contain a second component of the product and maintain the second component separate from the first component; (c) a dispensing head, in fluid communication with the first and second chambers, through which the product is dispensed; and (d) a valve assembly including a valve stem and a biasing element constructed to move the valve stem from an open, actuated position, in which the first and second components flow simultaneously from the first and second chambers to the dispensing head, to a closed, normal position in which the first and second chambers are sealed.

Generally, the valve stem is a multi-global valve stem having a first lobe defining a first valve portion in communication with the first chamber, and a second lobe defining a second valve portion in communication with the second chamber.

Some implementations may include one or more of the following features. The valve stem includes a plurality of openings, and the valve assembly further comprises a valve seal configured to seal the openings when the valve stem is in its closed, normal position. The dispensing system further includes an actuator configured to be actuated by a user to move the valve stem from its closed, normal position to its open, actuated position. The multi-lobal valve stem defines a first fluid passageway between the first chamber and the actuator, and a second fluid passageway between the second chamber and the actuator. The actuator defines first and second fluid passageways configured to maintain the first and second components separate during dispensing, the first and second passageways of the actuator being in respective fluid communication with the first and second passageways of the valve stem. The valve assembly includes a valve body configured to inhibit movement of the valve seal when the valve is in use.

The term "pressurized", as used herein, is intended to encompass both pressurization as a result of a propellant and pressurization resulting from other causes, e.g., a mechanical force applied by a spring.

The details of one or more embodiments of the invention are set forth in the accompanying drawings and the description below. Other features and advantages of the invention will be apparent from the description and drawings, and from the claims.

DESCRIPTION OF DRAWINGS

FIGS. 2 and 2A are cross-sectional views taken along a plane perpendicular to the plane through which FIGS. 1 and 1A are taken.

FIG. 7 is a perspective view of an adaptor that may be used with the dispensing system shown in FIG. 1. FIG. 7A is a cross-sectional view of the adaptor, taken along line A—A in FIG. 7.

Like reference symbols in the various drawings indicate like elements.

DETAILED DESCRIPTION

Figure 1:
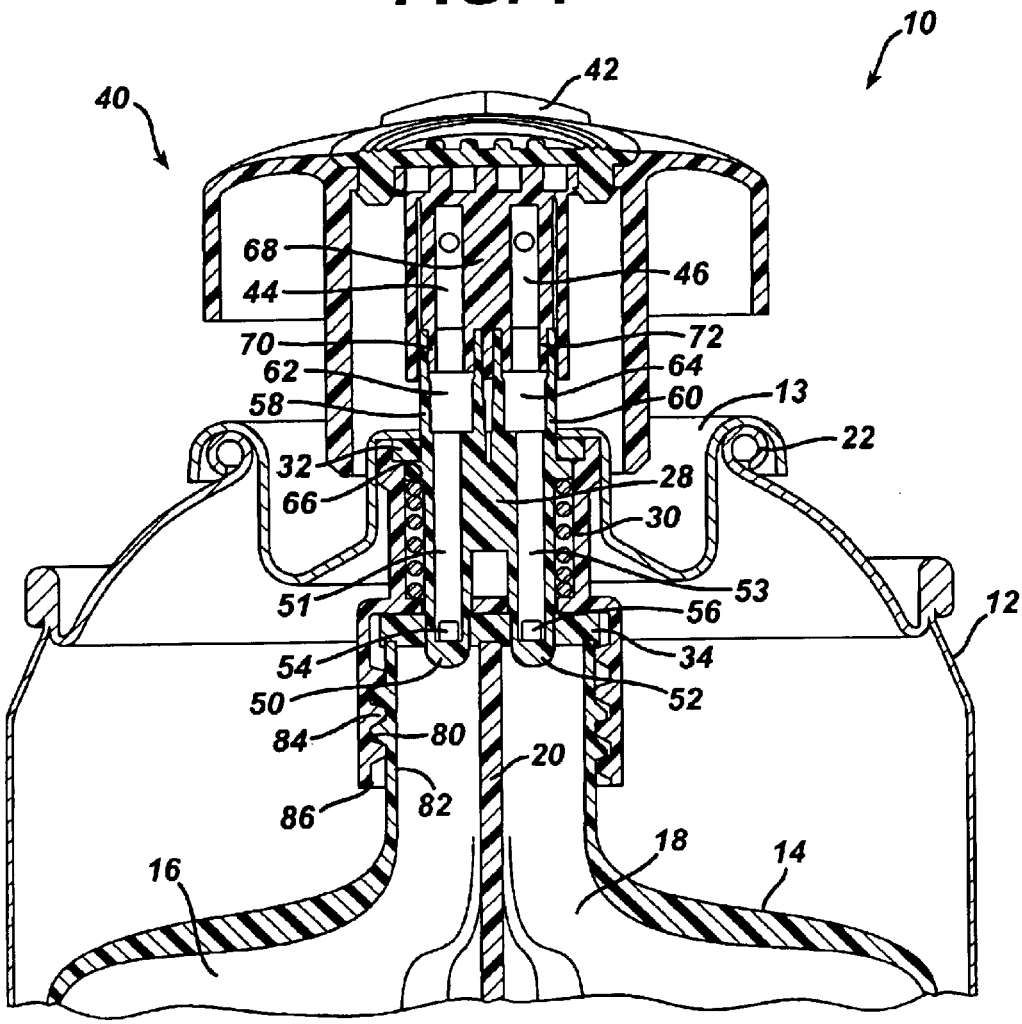
FIGS. 1 and 1A are cross-sectional views of a dispensing system according to one embodiment of the invention, with the valve shown in a closed position and an open position, respectively.
Figure 1A:
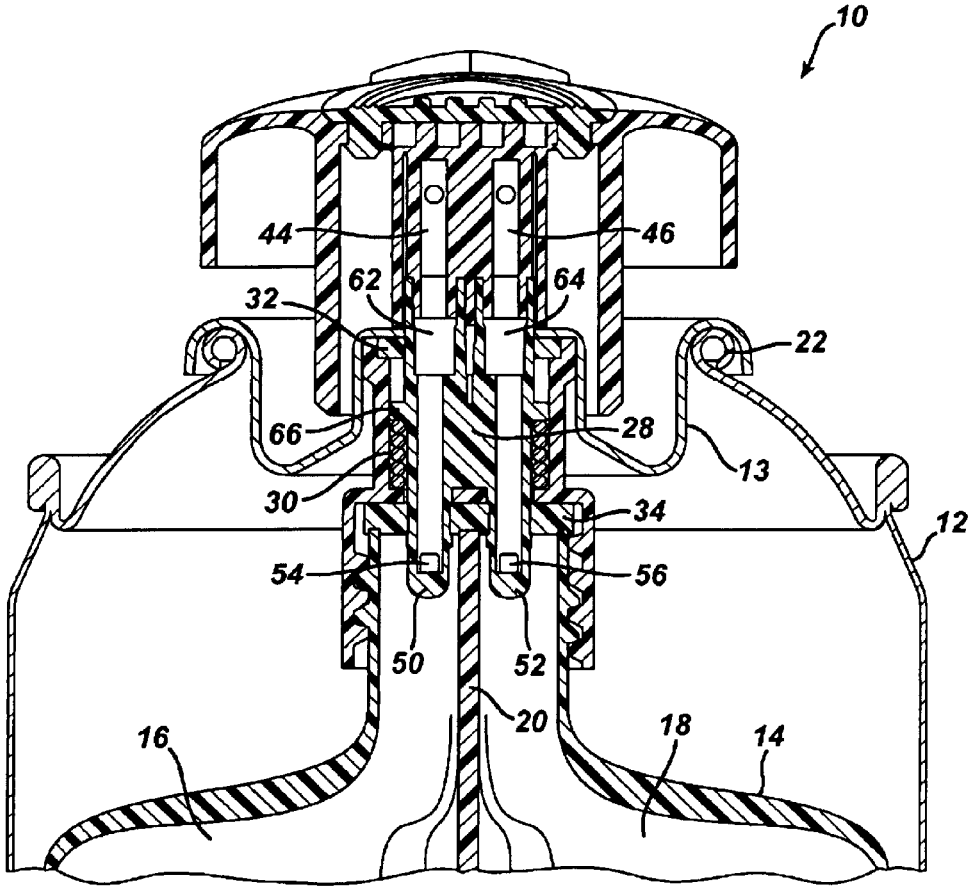

A preferred dispensing system 10 is shown in FIG. 1. Dispensing system 10 includes a canister 12 and, within canister 12, an elongated bag 14. Bag 14 defines a first chamber 16, for containing a first component, and a second chamber 18, separated from the first chamber 16 by a wall 20, for containing a second component. A valve cup 13, which is generally formed of metal, is crimped around a circumferential rim 22 of canister 12, forming a sealed container that can be pressurized.

Figure 3:
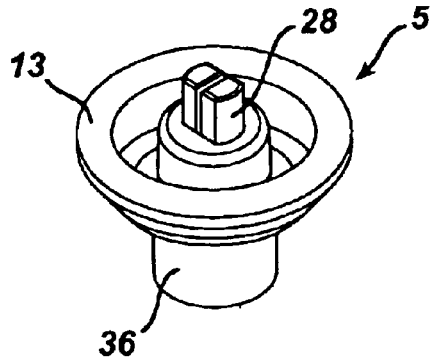
FIG. 3 is a perspective view of the modular dispensing valve assembly of the system of FIG. 1, removed from the dispensing system.
Figure 3A:
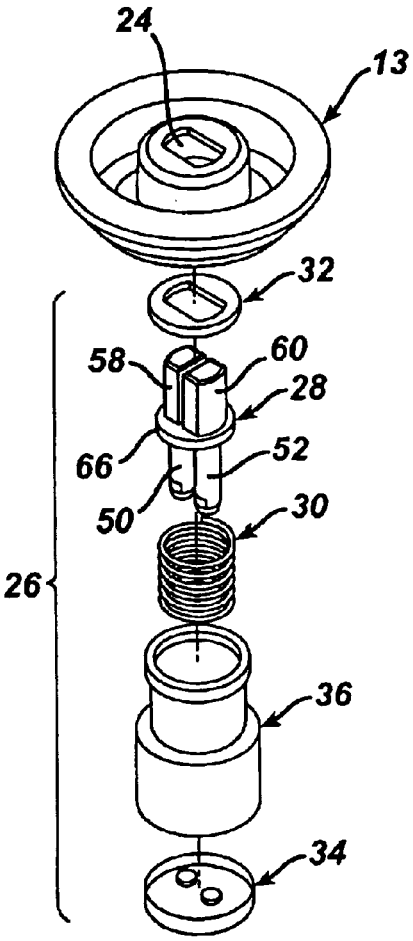
FIG. 3A is an exploded view of the modular valve assembly.

As shown in FIGS. 3 and 3A, valve cup 13 includes a central valve opening 24, into which are mounted valve components 26 (FIG. 3A), forming a modular valve assembly 5 (FIG. 3). Valve assembly 5 fits easily into a canister having a standard can opening, and can be integrated into standard manufacturing procedures with normal tolerances. The valve components 26 include a valve stem 28, a spring 30, a gasket 32, and a valve seal 34, contained within a valve body 36. As shown in FIG. 1, the valve body 36 includes openings through which the lobes 50, 52 of the valve stem 28 extend when the valve is assembled. These openings may be generally round, corresponding in shape to the lobes, or may be elongated if desired.

Figure 4:
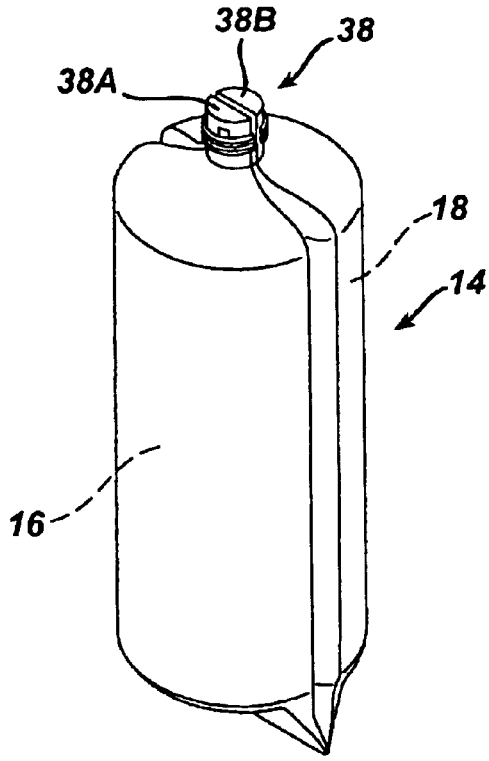
FIG. 4 is a perspective view of the bag used in the dispensing system shown in FIG. 1.
Figure 6:
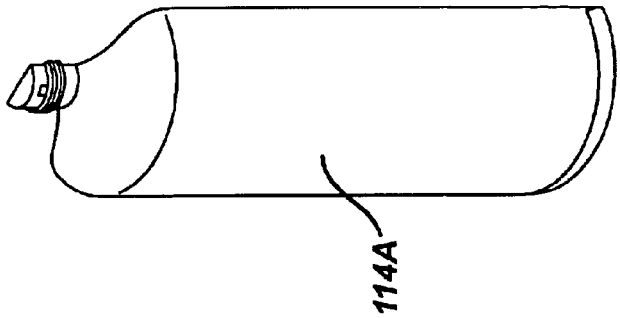
FIG. 6 is a perspective view of the bag used in the dispensing system shown in FIG. 1.

If bag 14 is sufficiently collapsible so that it can be inserted, when empty, through the opening at the top of canister 12 (typically about 1 inch in diameter), the modular valve assembly 5 may be pre-assembled by inserting the valve stem 28 through opening 24 in the valve cup 13, and crimping the valve cup 13 to the valve body 36. The outlet 38 (FIG. 4) of the elongated bag 14 is mounted in fluid communication with the lower end of the valve assembly 5, and the modular valve assembly 5, with bag 14 attached, can then be dropped into the canister 12 and crimped onto rim 22 during high-speed manufacturing. After the valve assembly 5 is crimped onto rim 22, the canister is pressurized and the bag is filled. Suitable collapsible bags for use in this process include foil bags, e.g., bags that are formed of a metal/plastic laminate that may be heat-sealed to the lower end of the valve assembly 5 or a suitable adapter, as will be discussed below. These foil bags may be rolled into an elongated spiral having a diameter that is smaller than that of the canister opening.

Alternatively, if the bag 14 is not sufficiently collapsible to fit through the opening, the bag 14 can be placed in the canister prior to closing the canister. The valve is then assembled by first joining the valve body 36 to the neck of the bag, e.g., by threaded engagement, and then assembling the valve components 26 into the valve body 36. Finally, the valve cup 13 is crimped onto rim 22 as discussed above. Suitable bags for use in this process include single-layer or multi-layer blow molded bags, which may be formed, for example, of Nylon, nylon/polyethylene, or polyethylene/EVA.

After the valve has been assembled into the canister, a dispensing head 40 is mounted over the valve cup 13. Dispensing head 40 includes an actuator 42 including a living hinge or other structure that allows the actuator to be depressed by a user and, when so depressed, to actuate valve assembly 5 as will be described below. Dispensing head 40 defines a first channel 44, for flow of the first component from chamber 16, and a substantially parallel second channel 46, for flow of the second component from chamber 18. Channels 44 and 46 are in fluid communication with nozzle 48 (FIG. 2), through which the product is dispensed.

The product is dispensed by compression of the bag 14, using any desired technique. For example, a propellant may be provided between the outer wall of the bag 14 and the inner wall of the canister 12, to compress the contents of the bag 14. The bag 14 may be configured to collapse as the product is exhausted, e.g., as described in U.S. Pat. No. 6,454,129, the disclosure of which is incorporated herein by reference.

The operation of valve assembly 5 will now be discussed, with reference to FIGS. 1–1A and 2–2A.

Valve stem 28 includes a pair of lobes 50, 52, configured to extend through portions 38A and 38B of outlet 38 of bag 14 (FIG. 4), and into chambers 16 and 18, respectively. Each lobe defines a channel 51, 53, and includes openings 54, 56, through which the components in the chambers can pass from the chambers into the channels when the valve is open. The valve stem also includes upper tubes 58, 60, which extend from lobes 50 and 52, respectively. Upper tubes 58 and 60 define channels 62, 64, which are in fluid communication with channels 44 and 46, respectively, of dispensing head 40. Preferably, the valve stem is a single, unitary part, for ease of manufacturing and economy.

Figure 2:
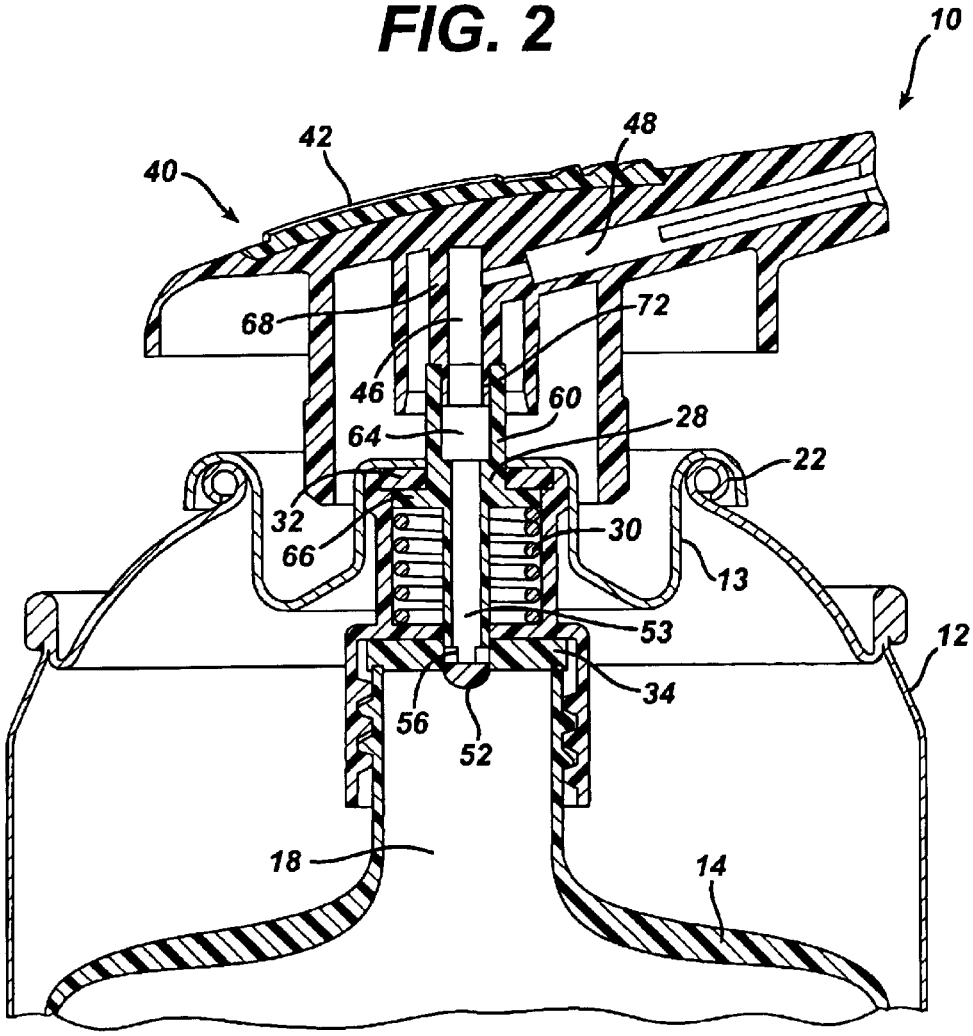

Valve stem 28 is mounted within spring 30, which biases the valve stem 28 towards the closed position shown in FIGS. 1 and 2. In this position, flange 66 of the valve stem 28 is positioned against gasket 32, which provides a stopping point for the valve stem, and openings 54, 56 are closed by valve seal 34. Preferably valve seal 34 is a resilient gasket, to provide a fluid-tight seal when the valve is in its closed position. Openings 54 and 56 in lobes 50 and 52 of the valve stem are unavailable for fluid flow from chambers 16 and 18 when the valve is closed, but allow the components to flow from their respective chambers into channels 51 and 53 when the valve opens.

Dispensing head 40 includes an actuating stem 68, having cylindrical lower portions 70, 72 which extend into and seat in the upper portion of tubes 58, 60 of the valve stem 28. When actuator 42 is depressed, actuating stem 68 presses valve stem 28 down, against the biasing force of spring 30. This movement simultaneously moves both lobes 50 and 52 of valve stem 28 downward. This downward movement moves openings 54, 56 away from valve seal 34, thereby moving the dispensing system to its open position, shown in FIGS. 1A and 2A. When the valves are opened, the first component flows from chamber 16, through openings 54 in lobe 50 and into channel 51. Simultaneously, the second component flows from chamber 18, through openings 56 in lobe 52 and into channel 53.

The valve design presents a number of advantages. Importantly, the two lobes of the valve stem are moved simultaneously, and thus material cannot be released from either chamber into the passages to the nozzle until the actuator is depressed. Because both lobes are part of a single valve stem, biased by a single spring, generally both components will be dispensed simultaneously, and one will not be dispensed without the other (unless one component is exhausted before the other). The relative positions of openings 54 and 56 are fixed, thus allowing the opening and closing of the flow paths through channels 62 and 64 to be held to a tight tolerance. Moreover, the location, size and geometry of the openings 54 and 56 can be held to a tight tolerance, allowing the ratio of the two components to be easily and accurately controlled. The valve assembly is robust, due to the positioning of the valve seal 34, which is confined by the valve body and thus cannot easily distort or flex. Because the flow paths from the two chambers are identical, it is relatively easy to calculate how to dispense a desired ratio of two components of the same or different rheologies, e.g., by changing the relative size of the openings 54, 56, and/or the relative diameters of the channels and tubes. The spring is sealed from contact with the components of the product, which may be advantageous if either component presents compatibility issues with metal parts.

Generally, the openings 54 and 56 in the valve stem are relatively large, preferably as large as can be accommodated by the design constraints of the valve stem. Having relatively large valve openings allows a high flow rate into the nozzle during filling of the dispensing system, and minimizes shear on the first and second components during filling and dispensing. The area of the openings is selected to allow the first and second components to be delivered into the container through the valve during a high-speed manufacturing process. It is generally desirable to fill through the valve because doing so facilitates high-speed in-line processing, and because, in some implementations (e.g., when the system includes a liner bag as will be discussed below), this technique allows the propellant to be charged to the container prior to filling, if desired. Charging the propellant prior to filling allows substantially all air to be evacuated from the container, which in turn prevents problems with the product such a premature foaming.

Propellant is sealed within the canister by the compression of gasket 32 between the valve body and the valve cup 13. Valve seal 34, in addition to controlling flow of the components from the chambers, also acts to prevent the propellant from entering the bag.

The dispensing systems of the invention may be filled with the components of the product using any suitable technique. An example of a suitable technique will be described below.

Prior to introduction of the components into the canister, a fixture is placed onto the valve stem and depressed to place the valve assembly in its open position. A vacuum is then drawn to evacuate air from the bag and canister and collapse the bag. A separate fixture is then used to open the valve and fill the two components into the two chambers, either simultaneously or one at a time. This fixture is then removed, allowing the valve assembly to return to its closed position. The propellant may be charged to the container before, during, or after the components have been filled into the chambers.

A number of embodiments of the invention have been described. Nevertheless, it will be understood that various modifications may be made without departing from the spirit and scope of the invention.

Figure 5:
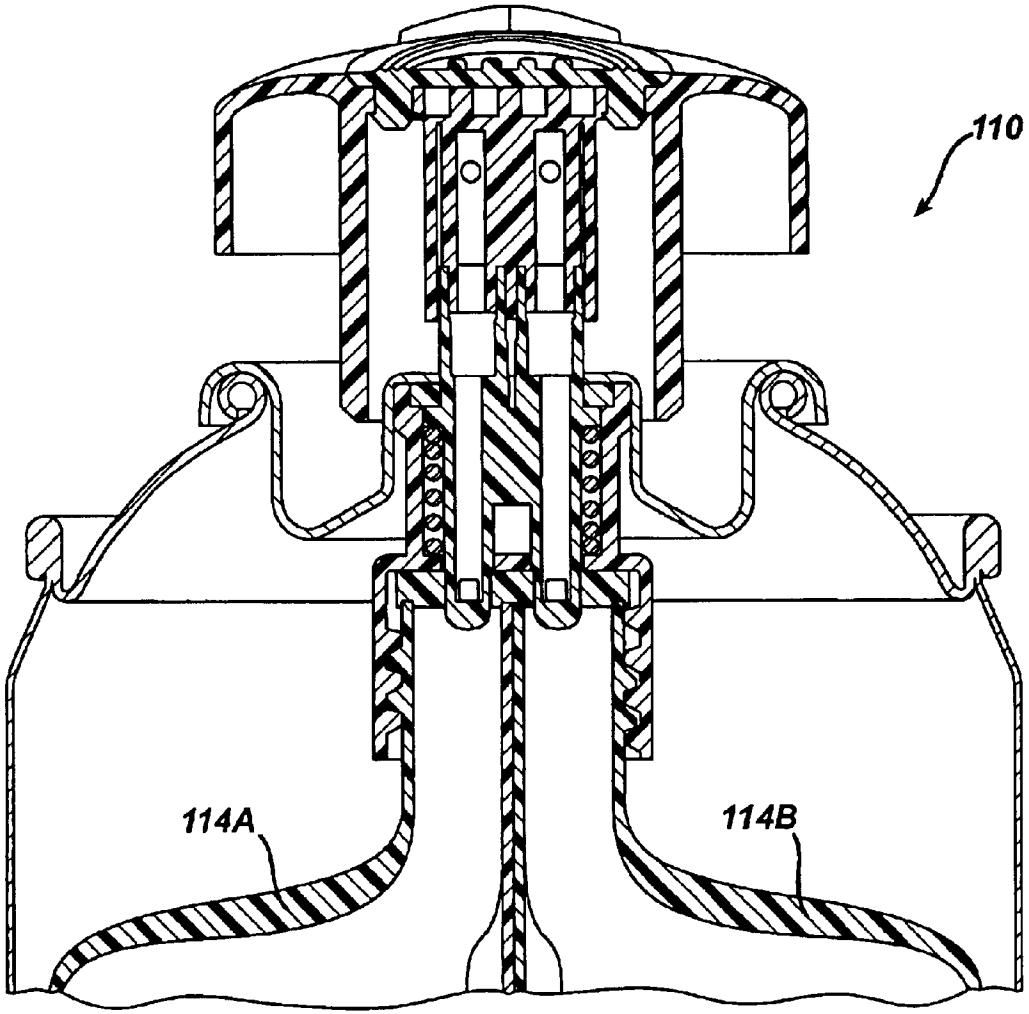
FIG. 5 is a cross-sectional view showing a dispensing system according to an alternative embodiment of the invention, with the valve shown in a closed position.

For example, any desired type of bag system may be used, provided that the chambers in which the components are contained are arranged so that the lobes of the valve stem can be extended into separate chambers. A dispensing system 110 having an alternate bag configuration, is shown in FIG. 5. Dispensing system 110 is similar to dispensing system 10, but differs in that the single multi-chamber bag 14, shown in FIG. 1, is replaced by a pair of single chamber bags 114A and 114B.

Moreover, the valve stem can have any desired number of lobes, disposed in a corresponding number of chambers. For example, if it is desired to dispense a three-component product, the valve stem may include three lobes disposed in three chambers of a single bag or separate bags. Moreover, the lobes can have any desired geometry and relative position.

Figure 2A:
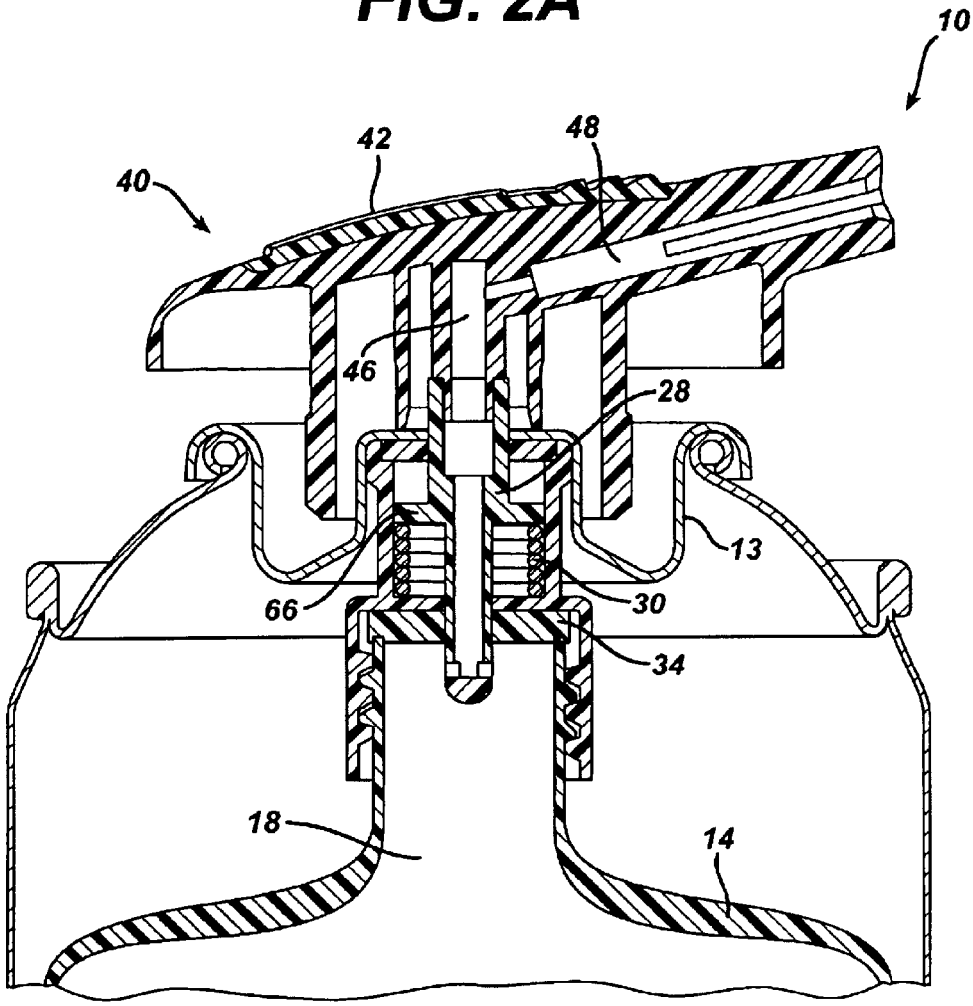

In addition, the bag may be attached to the valve assembly using any desired method. For example, the neck of the bag may be threaded, to engage a threaded inner portion of the valve body. This configuration is shown in FIGS. 1–2A, in which threads 80 on neck 82 of bag 14 engage threads 84 on inner wall 86 of valve body 36. Other suitable methods may be used, including clamps, snaps, and other mechanical seals. If a thin-walled bag is used, e.g., a foil bag, it may be desirable to provide an adaptor to which the bag can be heat-sealed. A suitable adaptor 200 is shown in FIGS. 7 and 7A. Adaptor 200 includes a pair of adaptor members 202, 204 that are joined, e.g., snapped or welded together, after heat sealing has been accomplished. Each adaptor member includes a fitting 206 that is configured to be received by the lower end of the valve body, and a flanged portion 208 that is configured to receive the upper end of the bag and provide a flange 210 about which the bag can be sealed. Each adaptor member also defines a bore 211, providing fluid communication between the bags and the valve assembly. Fitting 206 may include ridges or threads 212, to provide a threaded or interference engagement with the valve body. Adaptor 200 includes separate adaptor members 202, 204 to facilitate heat sealing using conventional equipment; however, the two adaptor members may be replaced by a single unitary member if desired.

If desired, the dispensing system may include a piston that sealingly and slidably engages the inner surface of the canister 12, defining a propellant chamber that is constructed to receive a propellant canister to pressurize the dispensing system. In this case, sliding movement of the piston towards the dispensing head 50, caused by the pressure exerted by the propellant, forces both components out through the nozzle 48 evenly and consistently when the actuator 42 is depressed by a user, opening the valve subassembly.

The dispensing head may be configured to keep the two components separate throughout delivery, or may be configured to mix the components during delivery.

Accordingly, other embodiments are within the scope of the following claims.

What is claimed is:

1. A pressurized dispensing system for dispensing a multi-component product, comprising:

(a) a first chamber constructed to contain a first component of the product;

(b) a second chamber constructed to contain a second component of the product and maintain the second component separate from the first component;

(c) a dispensing head, in fluid communication with the first and second chambers, through which the product is dispensed; and (d) a valve assembly comprising a multi-global valve stem having a first lobe defining a first valve portion in communication with the first chamber, and a second lobe defining a second valve portion in communication with the second chamber, and a biasing element configured to move the multi-global valve stem from an open, actuated position, in which the first and second components flow simultaneously from the first and second chambers to the dispensing head, to a closed, normal position in which the first and second chambers are sealed.

2. The dispensing system of claim 1 wherein the biasing element comprises a spring.

3. The dispensing system of claim 2 wherein the valve assembly further comprises a valve body, and the spring and valve stem are contained within the valve body.

4. The dispensing system of claim 3 wherein the valve stem includes a plurality of openings, and the valve assembly further comprises a valve seal configured to seal the openings when the valve stem is in its closed, normal position.

5. The dispensing system of claim 1 further comprising an actuator configured to be actuated by a user to move the valve stem from its closed, normal position to its open, actuated position.

6. The dispensing system of claim 5 wherein the multi-lobal valve stem defines a first fluid passageway between the first chamber and the actuator, and a second fluid passageway between the second chamber and the actuator.

7. The dispensing system of claim 6 wherein the actuator defines first and second fluid passageways configured to maintain the first and second components separate during dispensing, the first and second passageways of the actuator being in respective fluid communication with the first and second passageways of the valve stem.

8. The dispensing system of claim 1 further comprising a canister in which the two chambers are disposed.

9. The dispensing system of claim 1 wherein the canister defines a can opening of approximately 1 inch.

10. The dispensing system of claim 9 wherein the valve assembly is configured to fit within the can opening of the canister.

11. The dispensing system of claim 4 wherein the valve body is configured to inhibit movement of the valve seal when the valve is in use.

12. The dispensing system of claim 1 wherein the first and second chambers comprise portions of a multi-chamber bag.

13. The dispensing system of claim 1 wherein the first and second chambers comprise first and second bags.

14. The dispensing system of claim 12 wherein the bag comprises a foil bag.

15. The dispensing system of claim 13 wherein the bags comprise foil bags.

16. The dispensing system of claim 12 wherein said multi-chamber bag includes a threaded neck.

17. The dispensing system of claim 13 wherein each bag includes a threaded neck.

18. The dispensing system of claim 12 further comprising an adaptor to which the bag can be heat sealed, the adaptor being configured to be mounted on a lower portion of the valve assembly and to provide fluid communication between the valve assembly and the chambers.

19. The dispensing system of claim 13 further comprising an adaptor to which the bag can be heat sealed, the adaptor being configured to be mounted on a lower portion of the valve assembly and to provide fluid communication between the valve assembly and the chambers.

* * * * *

UNITED STATES PATENT AND TRADEMARK OFFICE

CERTIFICATE OF CORRECTION

PATENT NO. : 6,923,342 B2
DATED : August 2, 2005
INVENTOR(S) : Steven M. Bourque and James L. Salemme It is certified that error appears in the above-identified patent and that said Letters Patent is hereby corrected as shown below:

Title page,
Item [56], References Cited, FOREIGN PATENT DOCUMENTS, delete the second instance of "WO 02/34636".

Column 6,
Lines 36 and 41, "multi-global" should be -- multi-lobal --.

Signed and Sealed this

Twenty-eighth Day of March, 2006

JON W. DUDAS
*Director of the United States Patent and Trademark Office*